US009289101B2

(12) United States Patent
Weir

(10) Patent No.: US 9,289,101 B2
(45) Date of Patent: Mar. 22, 2016

(54) COLLAPSIBLE TOILET ENCLOSURE

(71) Applicant: WEZOR Inc., Maidstone (CA)

(72) Inventor: Robert Ritchie Weir, Belle River (CA)

(73) Assignee: Wezor Inc., Maidstone (CA)

( * ) Notice: Subject to any disclaimer, the term of this patent is extended or adjusted under 35 U.S.C. 154(b) by 0 days.

(21) Appl. No.: 14/437,194

(22) PCT Filed: May 20, 2014

(86) PCT No.: PCT/CA2014/050466
§ 371 (c)(1),
(2) Date: Apr. 20, 2015

(87) PCT Pub. No.: WO2014/186890
PCT Pub. Date: Nov. 27, 2014

(65) Prior Publication Data

US 2015/0272407 A1 Oct. 1, 2015

(30) Foreign Application Priority Data

May 22, 2013 (CA) ..... 2816750

(51) Int. Cl.
*A47K 11/04* (2006.01)
*E04H 1/12* (2006.01)

(52) U.S. Cl.
CPC ..... *A47K 11/04* (2013.01); *E04H 1/1216* (2013.01)

(58) Field of Classification Search
CPC ..... A47K 11/04
USPC ..... 4/449–486
See application file for complete search history.

(56) References Cited

U.S. PATENT DOCUMENTS 689,164 A * 12/1901 Castle ..... A47K 3/325 4/599
1,477,482 A * 12/1923 Harpin ..... D06F 3/02 248/27.5
1,785,375 A * 12/1930 Buchanan ..... B01J 9/18 423/308
1,912,425 A * 6/1933 Baumer ..... E04H 1/1244 135/145
2,005,009 A * 6/1935 Scheu ..... A01G 13/06 431/287
2,202,005 A * 5/1940 Holmgren ..... A43D 44/00 12/126
2,781,766 A * 2/1957 Krieger ..... E04H 15/001 135/116

(Continued)

FOREIGN PATENT DOCUMENTS

CN 200520089149.8 7/2006
DE 20 2005 009 772 U1 10/2005

(Continued)

*Primary Examiner* — Lori Baker
(74) *Attorney, Agent, or Firm* — Brunet & Co.; Robert A.H. Brunet

(57) ABSTRACT

A collapsible toilet enclosure has a base portion having a toilet aperture and a holding receptacle in fluid communication with the toilet aperture. The base portion has walls defining an inner space. An upper frame portion is pivotally connected to the base portion, the upper frame portion having a front wall, the upper frame portion being pivotable relative to the base portion between a collapsed position where the upper frame portion forms a lid for the base portion and a vertical position where the upper frame portion and a front wall of the base portion form a front wall of the toilet enclosure. The collapsible toilet has may be selectively secured to the upper frame portion in the vertical position. A doorframe is formed by an opening in the front wall of the upper frame portion and an opening in the base portion, the openings aligning to form the doorframe when the upper frame portion is in the vertical position.

19 Claims, 16 Drawing Sheets

(56) References Cited

U.S. PATENT DOCUMENTS 3,345,928 A * 10/1967 Krehbiel ..... G03D 3/06 34/658
3,351,078 A * 11/1967 Kleiman ..... B60P 3/38 135/148
3,482,585 A * 12/1969 Overstreet ..... E04H 1/12 135/120.2
3,884,522 A * 5/1975 Arima ..... B63B 29/04 114/363
4,031,572 A * 6/1977 Harding ..... E04H 1/1216 4/463
4,252,136 A * 2/1981 Kruczynski ..... E04H 15/02 135/148
4,536,902 A * 8/1985 McGill ..... A47K 11/02 4/449
4,710,989 A * 12/1987 Grenthe ..... A47K 11/04 4/449
4,854,261 A * 8/1989 Goldsmith ..... B63B 29/04 114/363
4,909,268 A * 3/1990 Maggio ..... A01M 31/02 135/902
4,934,396 A * 6/1990 Vitta ..... E04H 15/46 135/139
4,974,265 A * 12/1990 Maggio ..... A47K 3/325 135/901
4,975,992 A * 12/1990 Patterson ..... A47K 3/325 4/599
4,979,242 A * 12/1990 Maggio ..... E04H 1/1244 135/901
5,029,348 A * 7/1991 Boren ..... B63B 29/14 4/312
5,379,466 A * 1/1995 Davies ..... A47K 11/00 4/449
5,671,487 A * 9/1997 Chen ..... E04H 1/1216 4/449
5,937,452 A 8/1999 Brewer
5,937,453 A * 8/1999 Hodak ..... E04H 4/1272 4/508
5,974,597 A * 11/1999 Conwell ..... A47K 11/00 4/431
6,378,142 B1 * 4/2002 Gray ..... E04H 1/1216 4/449
6,393,627 B1 * 5/2002 Avila ..... A47K 11/02 4/449
6,681,413 B2 * 1/2004 Weiss ..... A47K 11/02 4/449
6,718,565 B1 * 4/2004 Cruz ..... E04H 1/1216 135/117
6,722,732 B1 * 4/2004 Menne ..... A47C 13/00 114/363
8,991,914 B2 * 3/2015 Grovender ..... B63B 29/14 114/361
2003/0121093 A1 * 7/2003 Braxton ..... E04H 1/1216 4/476
2008/0034489 A1 * 2/2008 Chen ..... A47K 11/02 4/483
2008/0209624 A1 * 9/2008 Lavoie ..... E04H 1/1216 4/449
2013/0055499 A1 * 3/2013 Miguel Serda ..... A47K 3/32 4/476
2014/0345039 A1 * 11/2014 Weir ..... A47K 11/00 4/476

FOREIGN PATENT DOCUMENTS

GB 345928 A 4/1931
GB 1477482 A 6/1997
JP 2005176998 A 7/2005
WO 2006029417 A1 3/2006
WO 2012013385 A1 2/2012

* cited by examiner

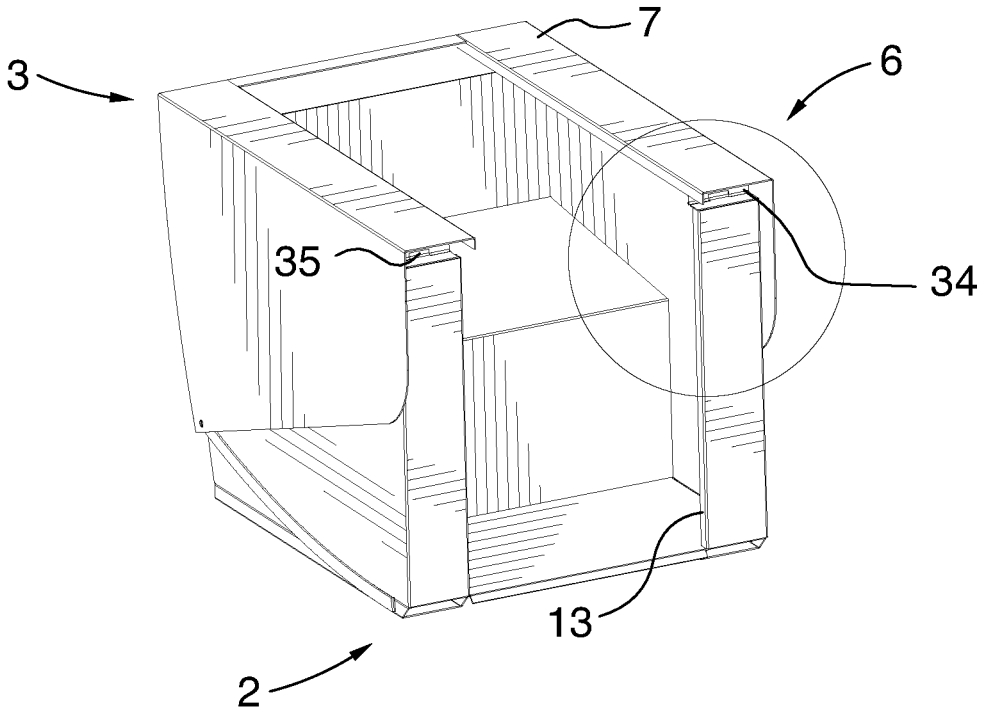
FIG.16
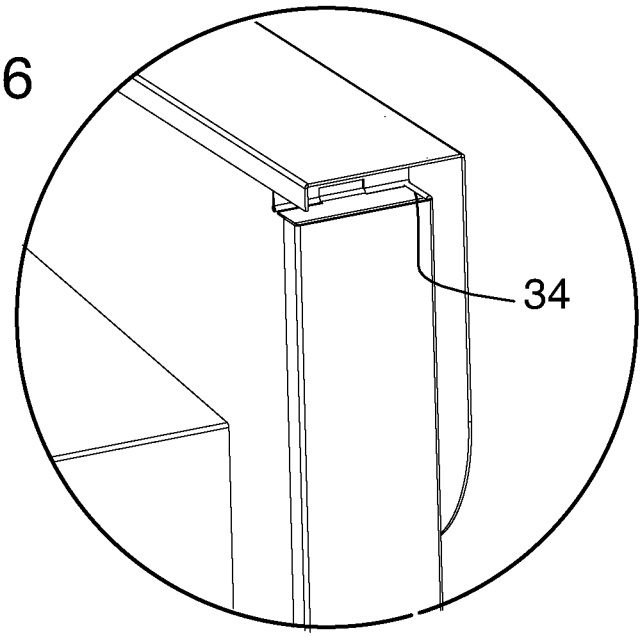

COLLAPSIBLE TOILET ENCLOSURE

CROSS-REFERENCE TO RELATED APPLICATIONS

This application is a §371 National Entry of International Patent Application PCT/CA2014/050466, filed May 20, 2014, which claims priority under the Paris Convention to Canadian Patent Application CA 2,816,750, filed May 22, 2013, the entire contents of which are herein incorporated by reference.

FIELD OF THE INVENTION

The invention relates to portable toilet enclosures, and particularly, to collapsible toilet enclosures and methods for extending and collapsing said toilet enclosures.

BACKGROUND

Portable toilet enclosures have been utilized for many years and are well known in the art. Standard portable toilet enclosures (such as U.S. Pat. No. 4,446,585) consist of a housing unit, comprised of a large, one-piece construction, containing a toilet within an enclosed space which a user may access through a door opening in the housing. These standard toilet enclosures are convenient given that they are portable and require very little in terms of assembly.

However, the main drawback of standard portable toilet enclosures is their large size and weight, which can make delivery, portability and storage difficult. The one-piece construction and shape makes maneuverability and delivery challenging, as typical commercial delivery vehicles have limited space available. Furthermore, the average person engaged in leisure activities, such as camping or picnics, who may require a portable toilet enclosure for extended periods of outdoor activities away from available bathroom facilities, are unable to utilize standard portable toilet enclosures given their large size and weight.

Attempts have been made to overcome the drawbacks associated with the standard portable toilet enclosures. Examples include U.S. Pat. No. 5,671,487 and U.S. Pat. No. 5,974,597, each of which disclose portable toilet enclosures that are collapsible for ease of storage and delivery. However, these portable toilet enclosures suffer from a lack of structural strength, given that they consist of a privacy screen supported on a thin framed assembly. Furthermore, these enclosures require a considerable amount of manual assembly, including several different components which require connection, and in some instances, posting and securing the enclosure to the ground.

There is therefore a need in the art for an improved collapsible toilet enclosure directed at overcoming the above-referenced drawbacks, particularly one that is lightweight and collapsible for ease of storage and delivery, has few components making it easy to assemble for use and has sufficient structural strength for use in a variety of applications.

SUMMARY OF THE INVENTION

According to the present invention, there is provided a collapsible toilet enclosure comprising a base portion and an upper frame portion, the upper frame portion being pivotally connected to the base portion. The base portion comprises a toilet aperture and a holding receptacle in fluid communication with the toilet aperture, the base portion having walls defining an inner space. The upper frame portion comprises a front wall, with the upper frame portion being pivotable relative to the base portion between a collapsed position where the upper frame portion forms a lid for the base portion, and an extended position where the upper frame portion and a front wall of the base portion form a front wall of the toilet enclosure. The toilet enclosure also comprises means for selectively securing the upper frame portion in the extended position and a doorframe formed by an opening in the front wall of the upper frame portion and an opening in the base portion, the openings aligning to form the doorframe when the upper frame portion is in the extended position.

In one aspect, there is provided a collapsible toilet enclosure wherein when the upper frame portion is in the collapsed position and covers the base portion, a roof of the upper frame portion is adjacent to a back wall of the base portion and side walls of the upper frame portion are adjacent to side walls of the base portion. The roof and side walls of the upper frame portion may be outside of the inner space of the base portion and the upper frame portion may surround the base portion at an upper edge of the base portion when the collapsible toilet is in the collapsed position. Furthermore, the roof and side walls of the upper frame portion may be substantially congruent in shape to the respective back and side walls of the base portion.

The means for securing the upper frame portion in the extended position may comprises one or more support posts, extending between the upper frame portion and the base portion. In one embodiment, the means for securing the upper frame portion in the extended position comprises first and second support posts pivotally connected to the upper frame portion and rotatable from a collapsed position to an extended position, the support posts being connectable to the base portion when in extended positions for securing the upper frame portion in the extended position. The first and second support posts may be pivotally connected to respective first and second side walls of the upper frame portion, and the first and second support posts may be rotatable to a position adjacent to the first and second side walls respectively when the support posts are in the collapsed position. Furthermore, the support post may be of an acruate shape.

The support posts and the base portion may comprise respective flanges and grooves corresponding to the flanges, for connecting the support posts to the base portion. Alternatively, the support posts may be connectable to the base through a pin-hole connection.

In a further embodiment, the upper frame portion may comprise one or more interconnected sections. In a preferred embodiment, the one or more interconnected sections comprises respective first, second and third interlocking sections The first, second and third interlocking sections each have respective first, second and third roof sections forming one continuous roof that extends to the back wall the base portion when the upper frame portion is in the extended position. The first, second and third interlocking sections may have respective first, second and third sets of sidewalls forming continuous, upper frame portion sidewalls that extend to the first and second sidewalls of the base portion when the upper frame portion is in the extended position.

In one embodiment, the upper frame portion may be pivotally connected to the base portion via first and second hinges disposed along the front wall of the upper frame portion and along the base portion on each side of the doorframe.

In one embodiment, the collapsible toilet enclosure may comprise a collapsible door pivotally mounted in the doorframe. The door may be pivotally mounted in the door frame to permit swinging between open and closed positions, and wherein the door may comprise pivotally connected first and second door sections so that the door is in an extended position when the upper frame portion is raised relative to the base portion. The door is lockable in the extended position, and the door may be lockable with a pin.

BRIEF DESCRIPTION OF THE DRAWINGS

Having summarized the invention, embodiments thereof will now be described with reference to the accompanying figures, in which:

FIG. 16 shows another front iso-metric view of the collapsible toilet enclosure of FIG. 1 in the collapsed position with a magnified view of a hinge between the upper frame portion and the base portion;

DETAILED DESCRIPTION

Figure 1:
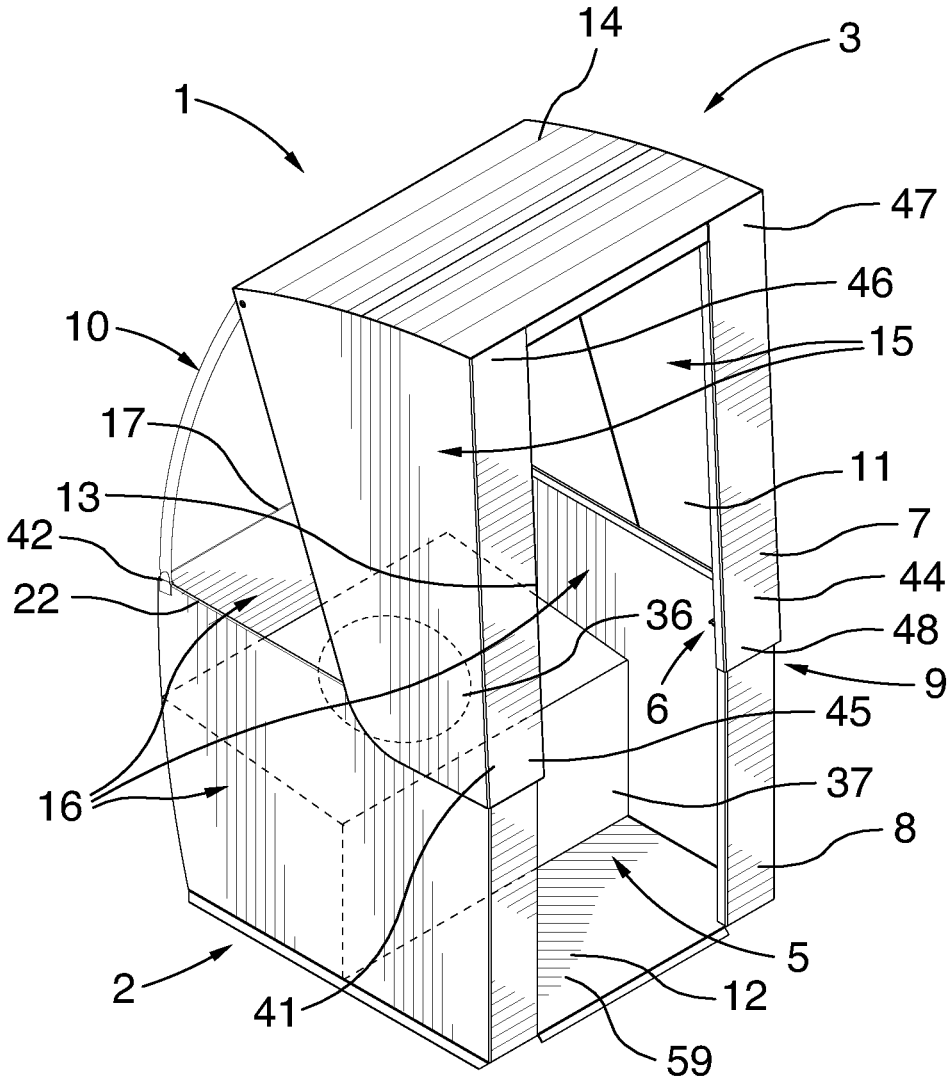
FIG. 1 shows a front iso-metric view of the collapsible toilet enclosure as described herein.

Throughout the drawings, like features will be designated by like reference numerals. Therefore, features corresponding to reference numerals shown in a drawing may not be described with reference to that particular drawing, but instead described with reference to another drawing. Similarly, features described with reference to a particular drawing may not be indicated with a reference on that drawing, but will be indicated with a reference numeral on another drawing.

A collapsible toilet enclosure 1 according to the present invention is generally illustrated in FIGS. 1 to 20. Referring to FIG. 1, the enclosure 1 comprises a base portion 2 and an upper frame portion 3, the upper frame portion 3 being pivotally connected to the base portion 2 through a pivotal connection 6. The base portion 2 comprises walls 16 forming an upper edge 22 of the base portion 2 and defining an inner space 5, the inner space containing a toilet seat 37 having a toilet aperture 36. In the embodiment of FIG. 1, upper edge 22 of the base walls 16 defines four corners 41, 42, 43, 44. The upper frame portion 3 comprises sidewalls 15, a front wall 7 and a roof 14.

The upper frame portion 3 is pivotable relative to the base portion 2 between a collapsed position (discussed below) and an extended position, the extended position illustrated in FIG. 1 where the upper frame portion 3 is substantially vertical. As seen in FIG. 1, the enclosure 1 comprises means 10 for means for selectively securing the upper frame portion 3 in the extended position. The upper frame portion 3 and base portion 2 each contain respective front walls 7, 8, each respective front wall 7, 8 having an opening 11, 12. The front wall 7 of the upper portion 3 defines four corners 45, 46, 47, 48. When in the upper frame portion 3 is in the extended position, the opening 11 in front wall 7 of the upper frame portion 3 and the opening 12 in the front wall 8 of the base portion 2 align to form a doorframe 13. As illustrated in FIG. 1, when the upper frame portion 3 is in the extended position, the front wall 7 of the upper frame portion 3 and the front wall 8 of the base portion 2 form a front wall 9 of the toilet enclosure 1.

The base portion 2 further comprises a base floor 59, The base walls 4 enclose and form the inner space 5 of the base portion 2. The doorframe 13 allows a user to conveniently enter and access the inner space 5 of the base portion 2. A toilet seat 37 with a toilet aperture 36 is positioned within the inner space 5 of the base portion 2, the toilet seat 37 resting upon the base floor 59, positioned abutting the back wall 17 of the base portion 2, directly across from the doorframe 13.

Figure 2:
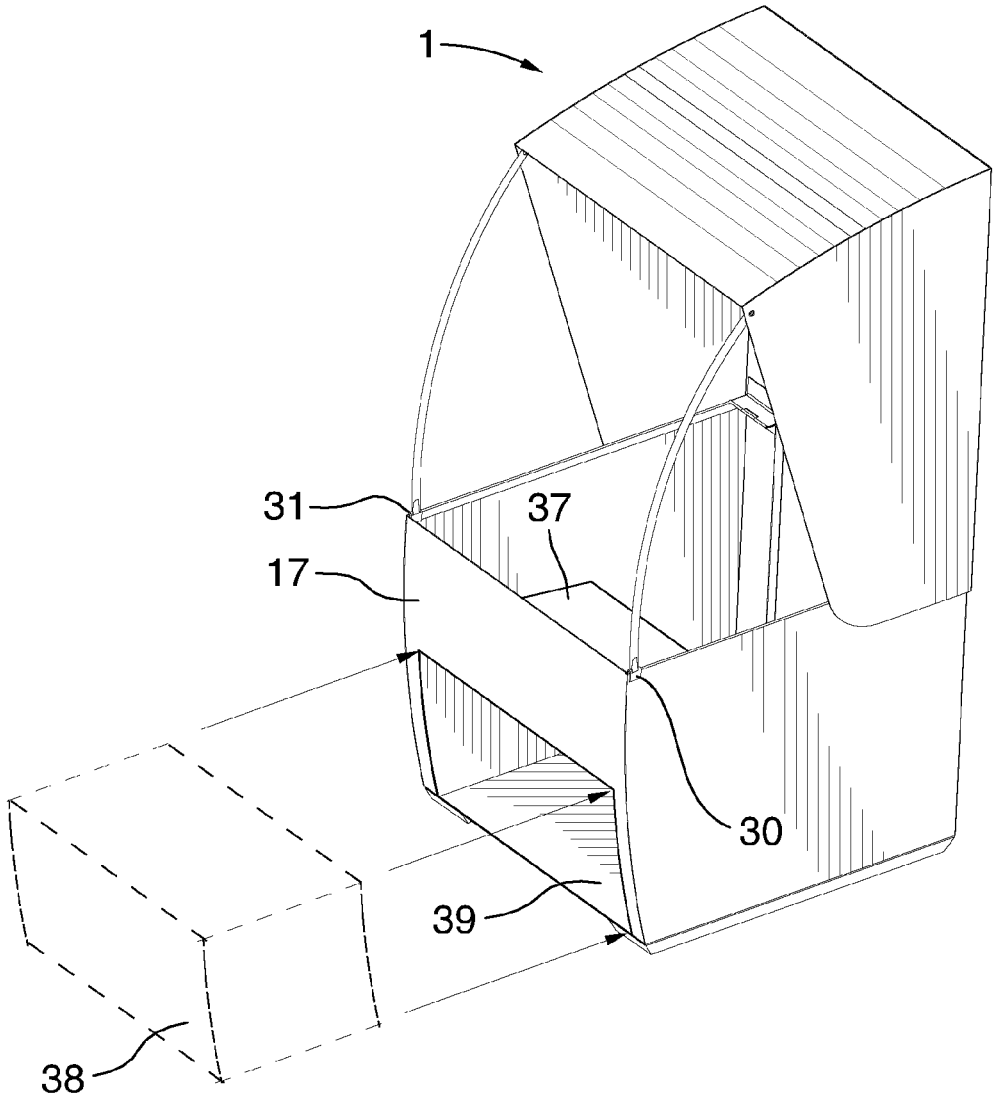
FIG. 2 shows a back iso-metric view of the collapsible toilet enclosure of FIG. 1 showing a holding receptacle in exploded view.

As seen in FIG. 2, the toilet enclosure 1 further comprises a holding receptacle 38, in fluid communication with the toilet aperture 36 in the toilet seat 37. In FIG. 2, the holding receptacle 38 is removable, and is stored within a chamber 39. The chamber 39 is accessed through the back wall 17 of the base portion 2, and is positioned below the toilet seat 37.

Figure 3:
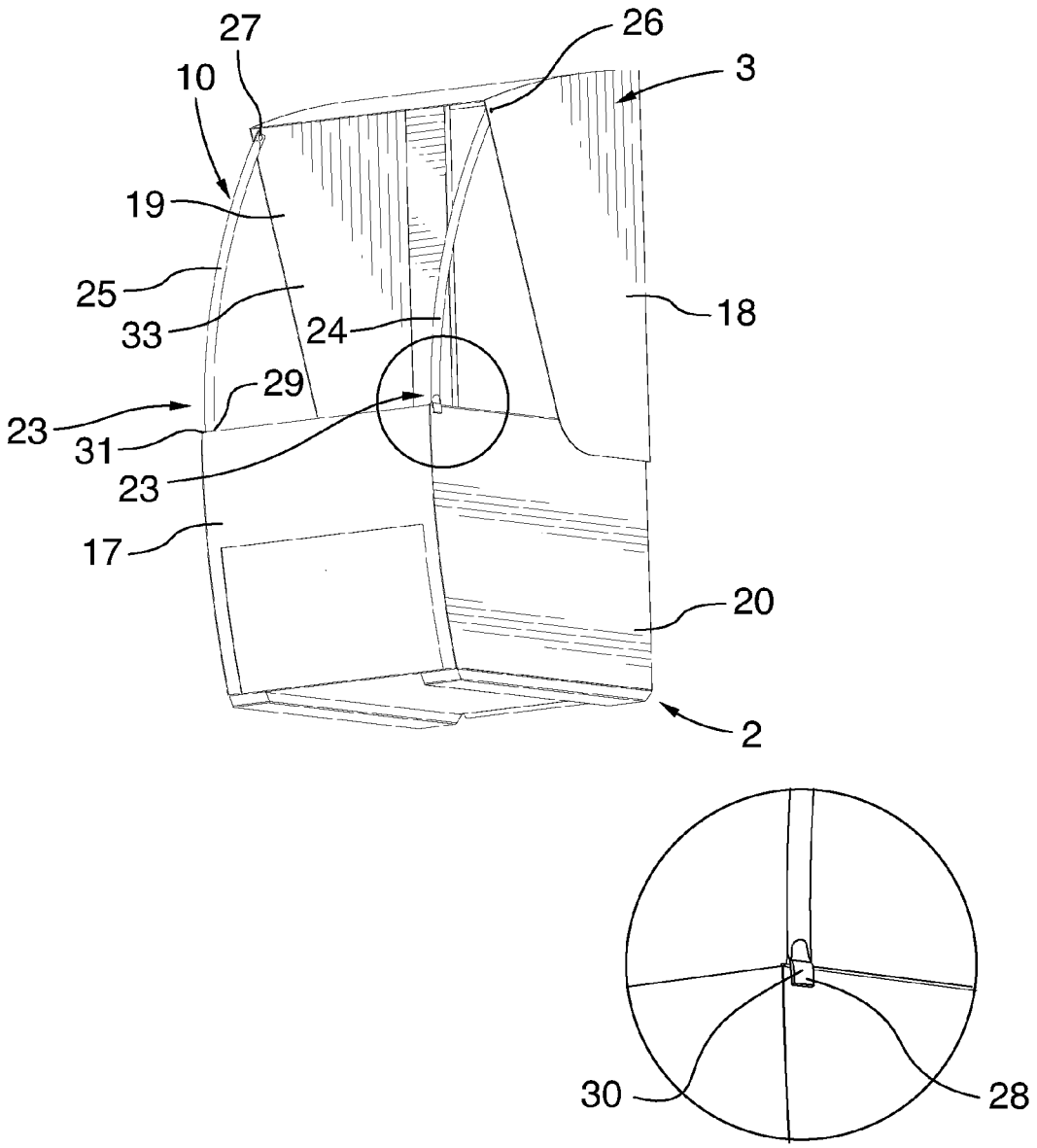
FIG. 3 shows another back iso-metric view of the collapsible toilet enclosure of FIG. 1.
Figure 4:
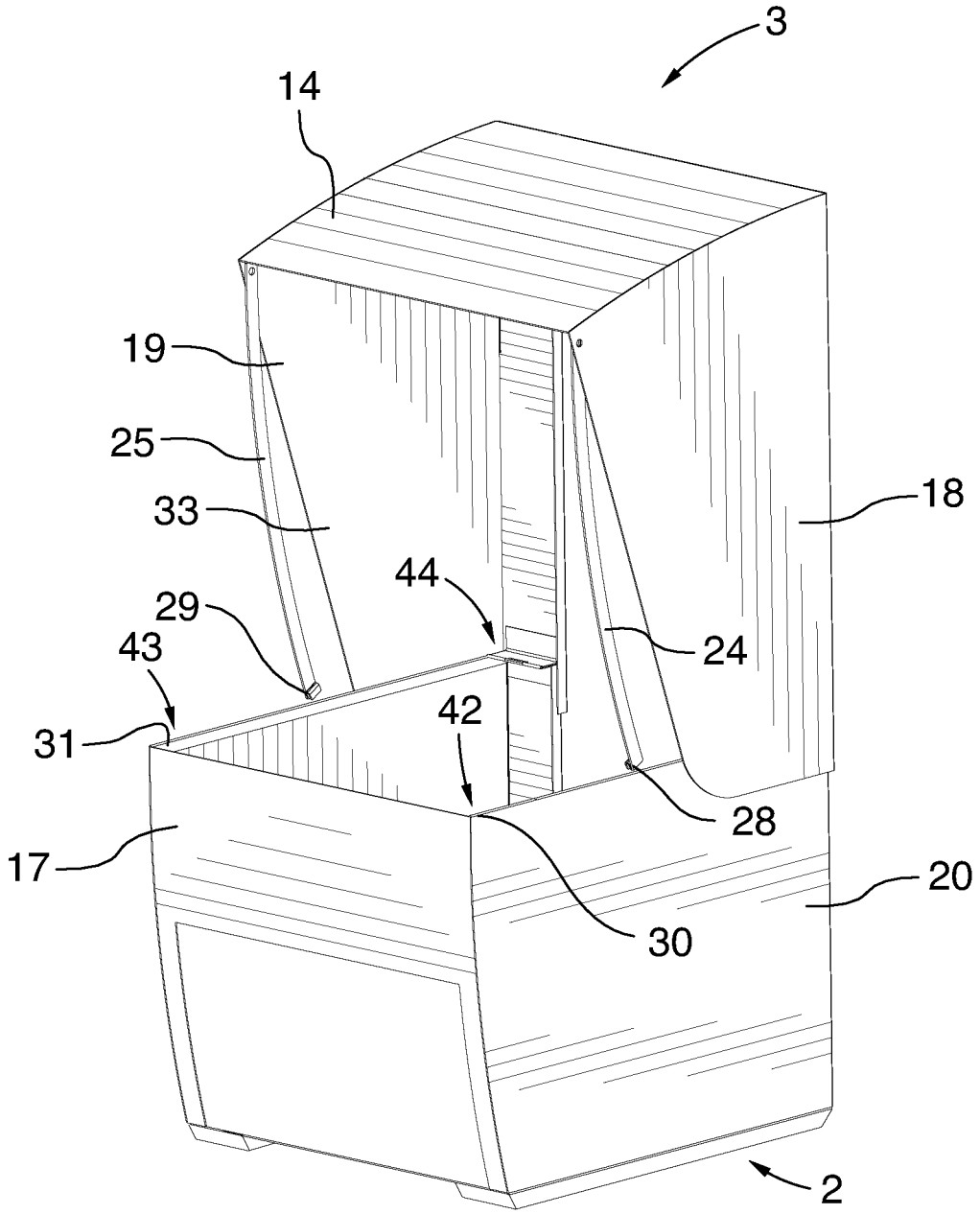
FIG. 4 shows a back iso-meteric view of the collapsible toilet enclosure of FIG. 1 with support posts disconnected from a base portion.

The means 10 for selectively securing the upper frame portion 3 in the extended position may comprise one or more support posts 23, extending between the upper frame portion 3 and the base portion 2. Referring to FIGS. 3 to 6, the means 10 for selectively securing the upper frame portion in the extended position comprises first and second support posts 24, 25. The first and second support posts 24, 25 are pivotally connected to respective first and second side walls 18, 19 of the upper frame portion 3 at respective first and second pivot connection points 26, 27. The first and second pivot connection points 26, 27 may comprise any pivotal connection points known in the art, such as a bolt and washer connection, a cotter pin, a rivet and the like. As seen in FIGS. 3 and 4, the first and second support posts 24, 25 are of an arcuate shape for structural strength and support.

Opposite the respective first and second pivot connection points 26, 27, the first and second support posts 24, 25 comprise first and second securing ends 28, 29 which connect to respective first and second securing points 30, 31 located upon the base portion 2. Referring to FIGS. 3 and 4, the first and second securing ends 28, 29 comprise flanges, and the first and second securing points 30, 31 comprise respective grooves configured to receive the flanges. As seen in FIG. 3, the first and second support posts 24, 25 rest upon the base portion 2, with the flanges of the first and second securing ends 28, 29 received by the grooves at the first and second securing points 30, 31, to secure and support the upper frame portion 3 in the extended position. However, any connection means known in the art could be used to secure the first and second support posts 24, 25 to the base portion 2, including locking pin-hole connections, bolts or clamps.

Figure 5:
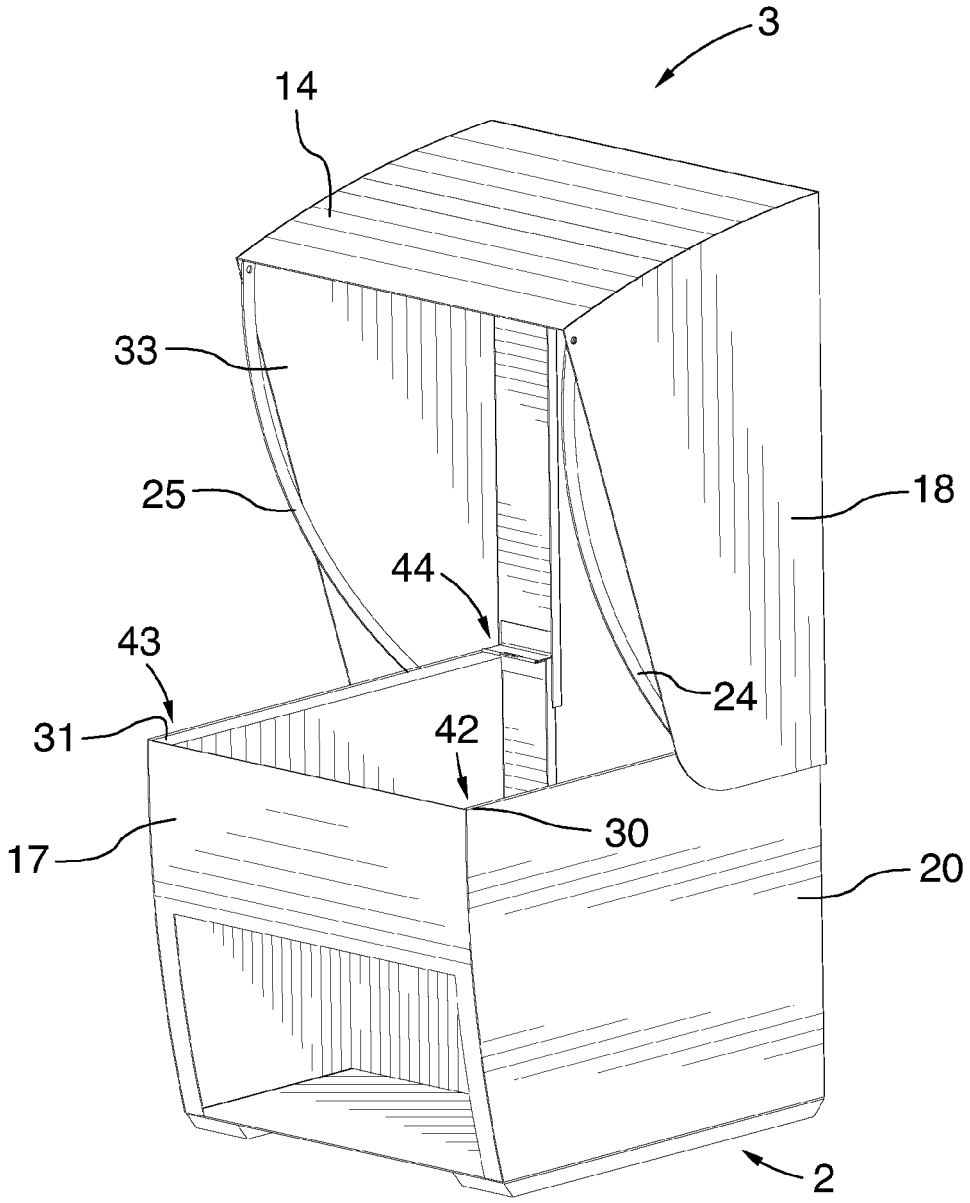
FIG. 5 and FIG. 6 show back iso-meteric views of the collapsible toilet enclosure of FIG. 1 with support posts in the process of collapsing.
Figure 6:
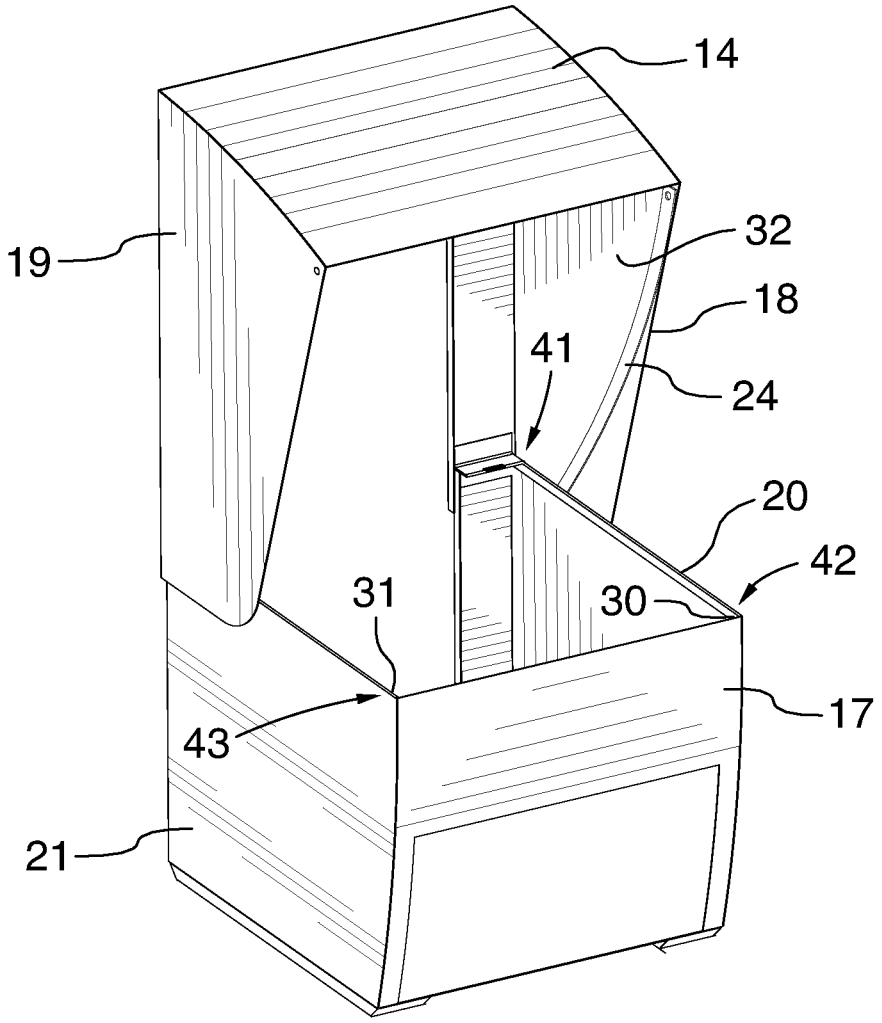

The operation of the securing means 10, and specifically the releasing of the securing means 10 in order collapse the upper frame portion 3, is illustrated in FIGS. 3 to 6. As seen in FIGS. 3 to 6, the first and second support posts 24, 25 are unsecured from the base portion 2 and are rotatable at respective first and second pivot connection points 26, 27. The first and second support posts 24, 25 are rotatable to a position adjacent to the first and second side walls 18, 19 of the upper frame portion 3. As seen in FIG. 6, the first and second support posts 24, 25 are rotated to a position between the interior surfaces 32, 33 of the respective first and second side walls 18, 19 of the upper frame portion 3 and the first and second side walls 20, 21 of the base portion 2. As such, the first and second support posts 24, 25 can be conveniently stored between the first and second side walls 18, 19 of the upper frame portion 3 and the first and second side walls 20, 21 of the base portion 2 when rotating the upper frame portion 3 to the collapsed position.

Figure 7:
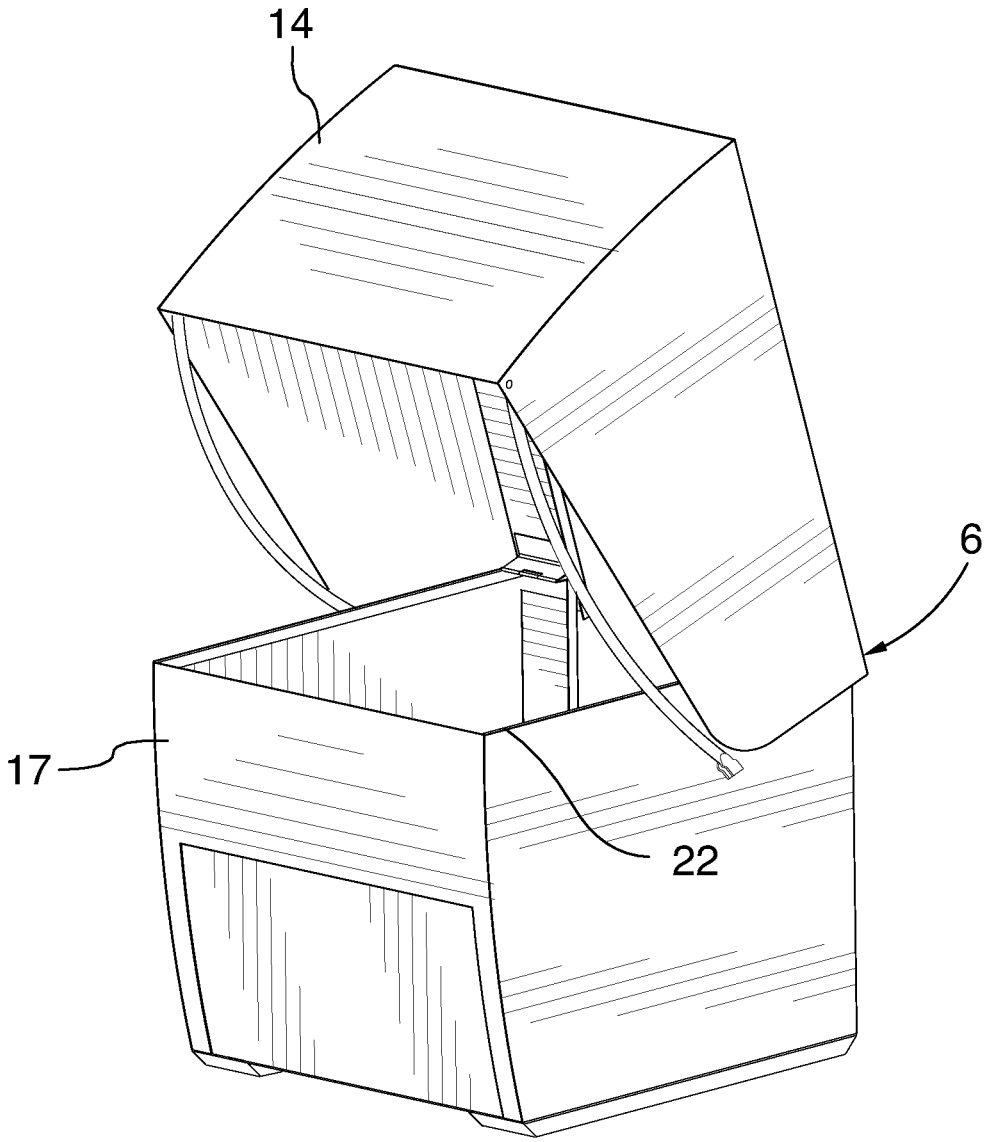
FIG. 7 shows a back iso-metric view of the collapsible toilet enclosure of FIG. 1 with an upper frame portion in the process of pivoting to a collapsed position.
Figure 8:
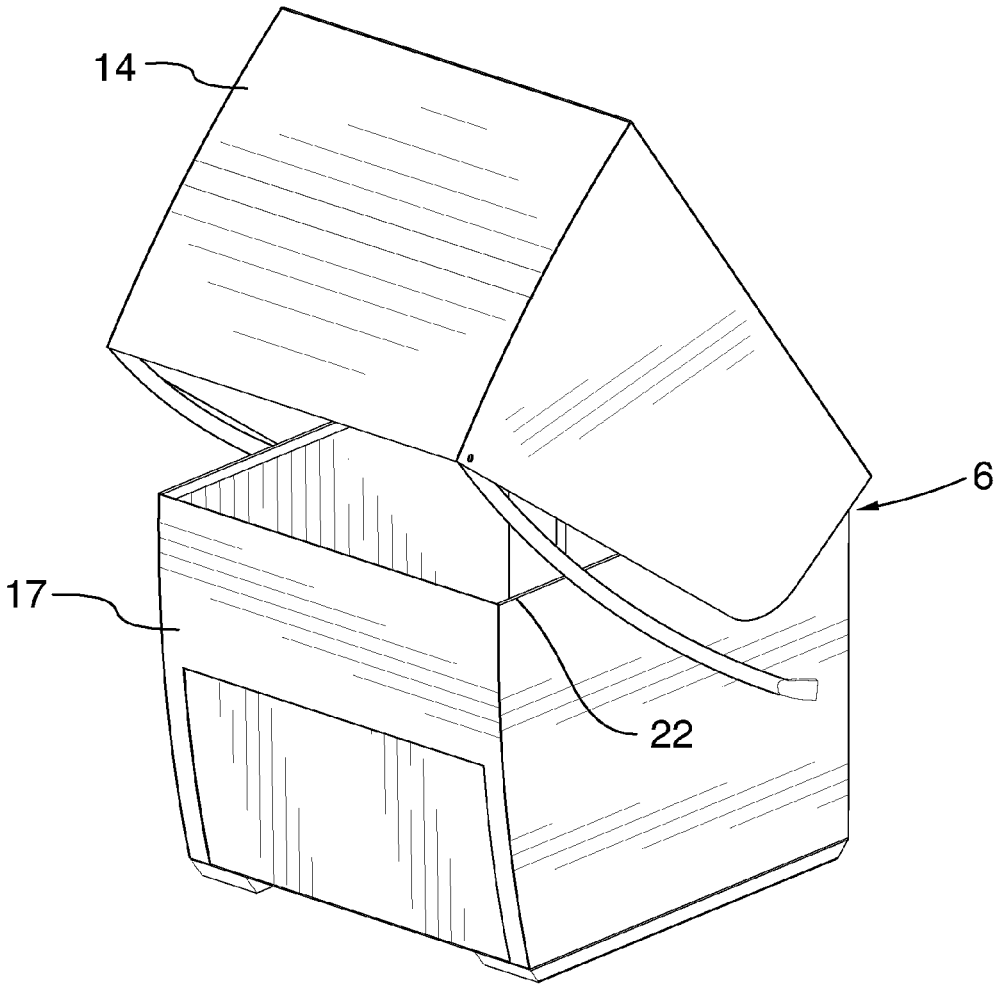
FIG. 8 shows a back iso-metric view of the collapsible toilet enclosure of FIG. 1 further along in the process of pivoting to the collapsed position.

FIGS. 6 to 8 illustrate the transitioning of the upper frame portion 3 from the extended position to the collapsed position. As seen in FIGS. 5 and 6, the first and second support posts 24, 25 are unsecured from the base 2, with the upper frame portion 3 still positioned in the upright, extended position. Referring to FIGS. 7 and 8, the upper frame support 3 is rotated relative to the base 2 about the pivotal connection 6. As the upper frame portion 3 is rotated towards the upper edge 22 of the base 2, the roof 14 of the upper frame portion 3 is into closer proximity with the back wall 17 of the base portion 2.

Figure 9:
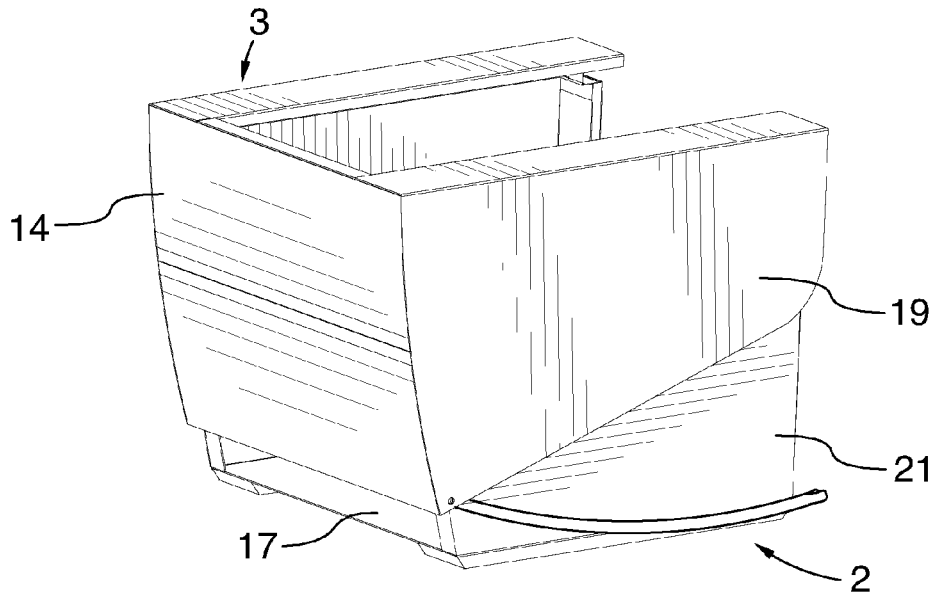
FIG. 9 shows a back iso-metric view of the collapsible toilet enclosure of FIG. 1 in the collapsed position.
Figure 10:
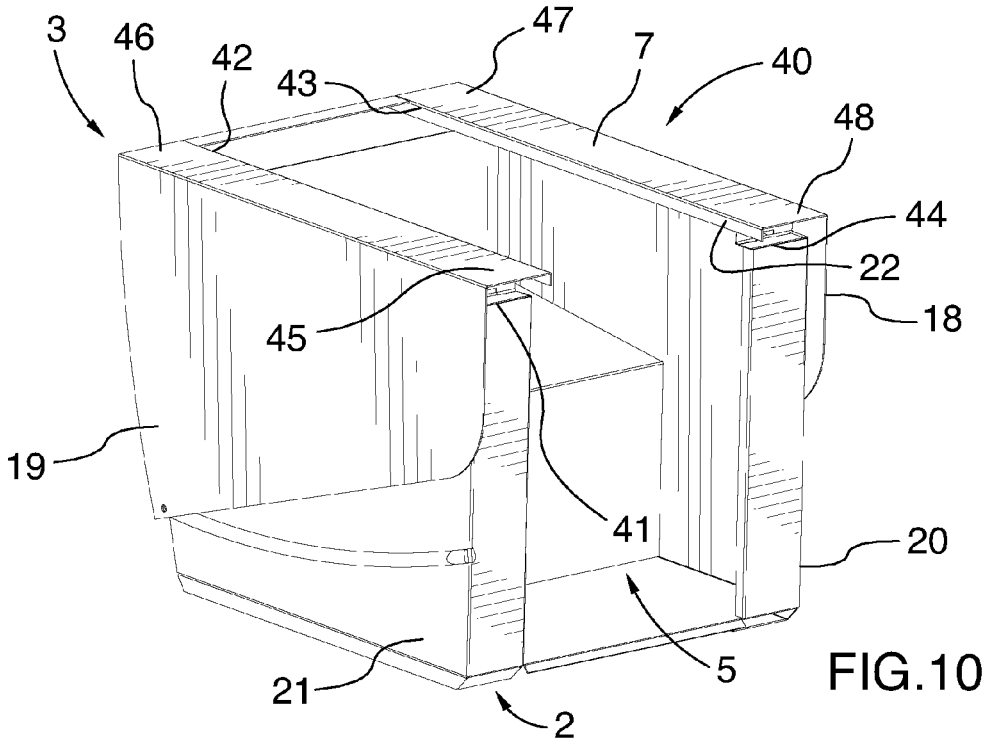
FIG. 10 shows a front iso-metric view of the collapsible toilet enclosure of FIG. 1 in the collapsed position.
Figure 11:
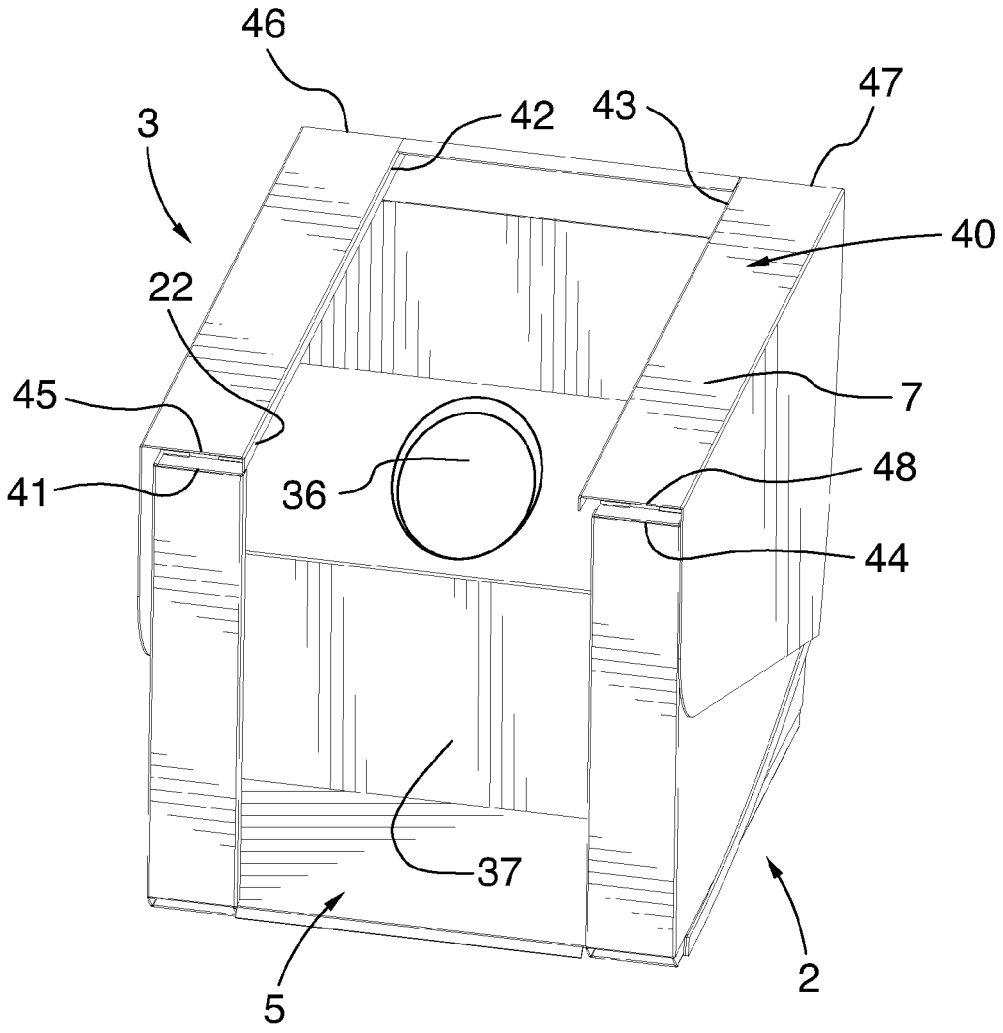
FIG. 11 shows another front iso-metric view of the collapsible toilet enclosure of FIG. 1 in the collapsed position.
Figure 12:
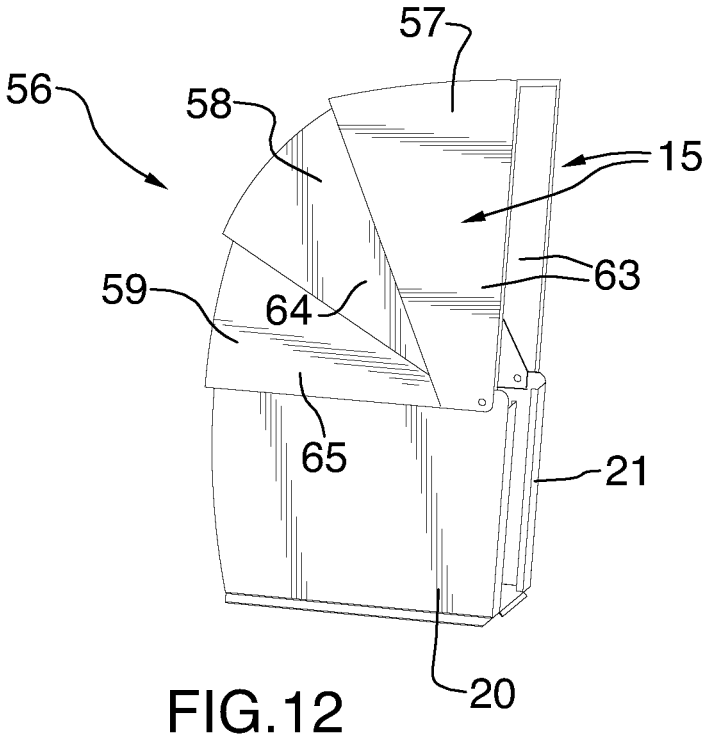
FIG. 12 shows a front iso-metric view of an alternative embodiment of the collapsible toilet enclosure of FIG. 1, the upper frame portion comprising one or more interconnected sections.
Figure 13:
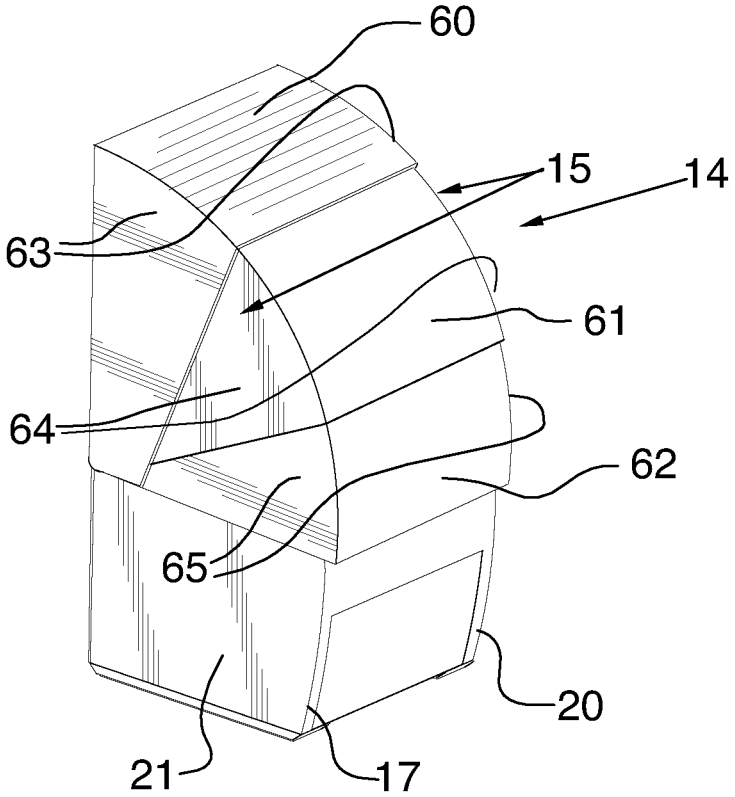
FIG. 13 shows a back iso-metric view of the of the collapsible toilet enclosure of FIG. 12.

The upper frame portion 3 is rotated towards the base portion 2 until reaching the collapsed position, as illustrated in FIGS. 9 to 11. As seen in FIGS. 9 and 10, in the collapsed position the upper frame portion 3 covers the base portion 2, with the roof 14 of the upper frame portion 3 adjacent to the back wall 17 of the base portion 2 and the first and second side walls 18, 19 of the upper frame portion 3 adjacent to the first and second side walls 20, 21 of the base portion 2. The roof 14 and the first and second side walls 18, 19 of the upper frame portion 3 are outside of the inner space 5 of the base portion 2, and the upper frame portion 3 surrounds the upper edge 22 of the base portion 3. The roof 14 and first and second side walls 18, 19 of the upper frame portion 3 are substantially congruent in shape to the respective back 17 and first and second side walls 20, 21 of the base portion 2. While this shape configuration provides both functional and aesthetic advantages, one skilled in the art would appreciate that while various shape configurations could be implemented without departing from the scope of the invention as claimed.

As illustrated in FIGS. 10 and 11, when in the collapsed position, the front wall 7 of the upper frame portion 3 rests upon the upper edge 22 of the base portion 2, with the four corners 41, 42, 43, 44 of the upper edge 22 aligning with the corresponding four corners 45, 46, 47, 48 of the front wall 7 of the upper frame portion 3. As such, when in the collapsed position, the upper frame portion 3 forms a lid 40 for the base portion 2.

Referring to the embodiment of FIGS. 12 to 15, the upper frame portion 3 may comprise one or more interconnected sections 56. As seen in FIGS. 12 to 15, the one or more interconnected sections 56 comprises respective first, second and third interlocking sections 57, 58, 59. In the preferred embodiment, the first, second and third interlocking sections 57, 58, 59 each have respective first, second and third roof sections 60, 61, 62, forming one continuous, quarter-sphere roof 14 that extends down to the back wall 17 of the base portion 2 when the upper frame portion 3 is in the extended position. Similarly, the first, second and third interlocking sections 57, 58, 59. each have respective first, second and third sets of sidewalls 63, 64, 65 forming continuous, upper frame portion sidewalls 15 that extend down to the first and second sidewalls 20, 21 of the base portion 2 when the upper frame portion 3 is in the extended position.

Figure 14:
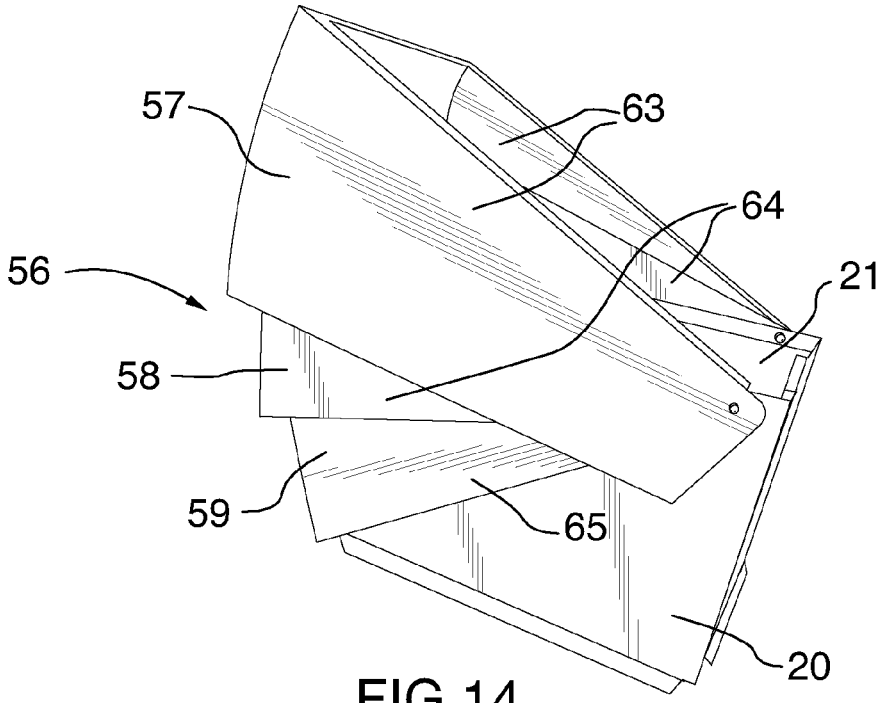
FIG. 14 shows a front iso-metric view of the collapsible toilet enclosure of FIG. 12 in the process of pivoting to the collapsed position.
Figure 15:
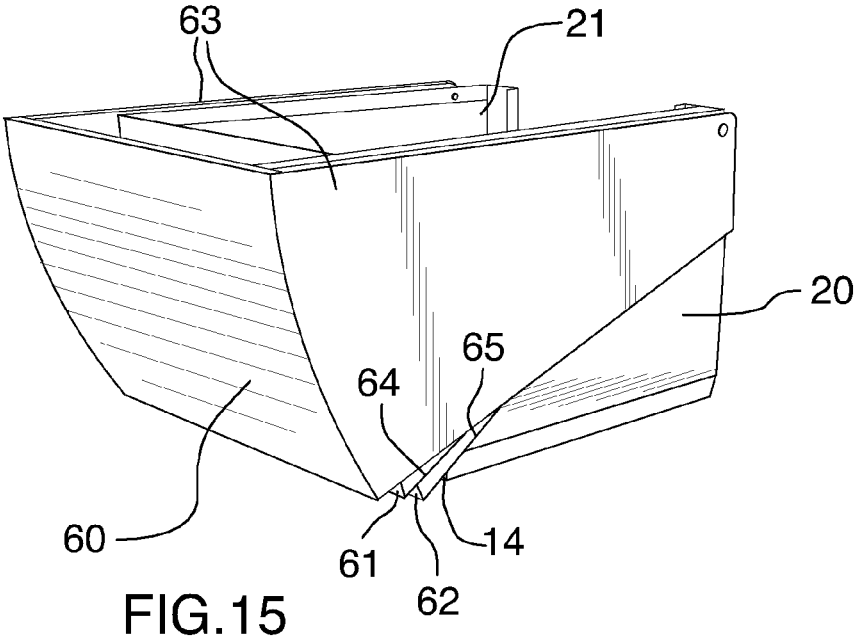
FIG. 15 shows a back iso-metric view of the collapsible toilet enclosure of FIG. 12 in the collapsed position.

As seen in FIGS. 14 and 15, as the upper frame portion 3 is pivoted to the collapsed position, each of the first, second and third interlocking sections 57, 58, 59 begin to overlap with one another and with the base portion 2 generally. The third roof section 62 moves to cover the back wall 17 of the base portion 2, the second roof section 61 moves to cover the third roof section 62, and the first roof section 60 moves to cover the second roof section 61. The third set of sidewalls 65 move to cover the first and second sidewalls 20, 21 of the base portion 2, the second set of sidewalls 64 moves to cover the third set of sidewalls 65, and the first set of sidewalls 63 moves to cover the second set of sidewalls 64. As seen in FIG. 15, in the fully collapsed position, the first, second and third roof section 60, 61, 62 are respectively layered or nested, one in front of the other, towards the back wall 14 of the base section 2, and the first, second and third sets of sidewalls 63, 64, 65 are respectively layered or nested, one in front of the other, towards the first and second sidewalls 20, 21 of the base portion 2.

FIG. 16 illustrates an embodiment of the pivotal connection 6, wherein the upper frame portion 3 is pivotally connected to the base portion 2 via first and second hinges 34, 35. The first and second hinges 34, 35 are disposed along the front wall 7 of the upper frame portion 3 and along the base portion 2, on each side of the doorframe 13. The first and second hinges 34, 35 can be connected to the upper frame portion 3 and the base 2 by any means known in the art, including screws, welding or various forms of adhesives.

Figure 17:
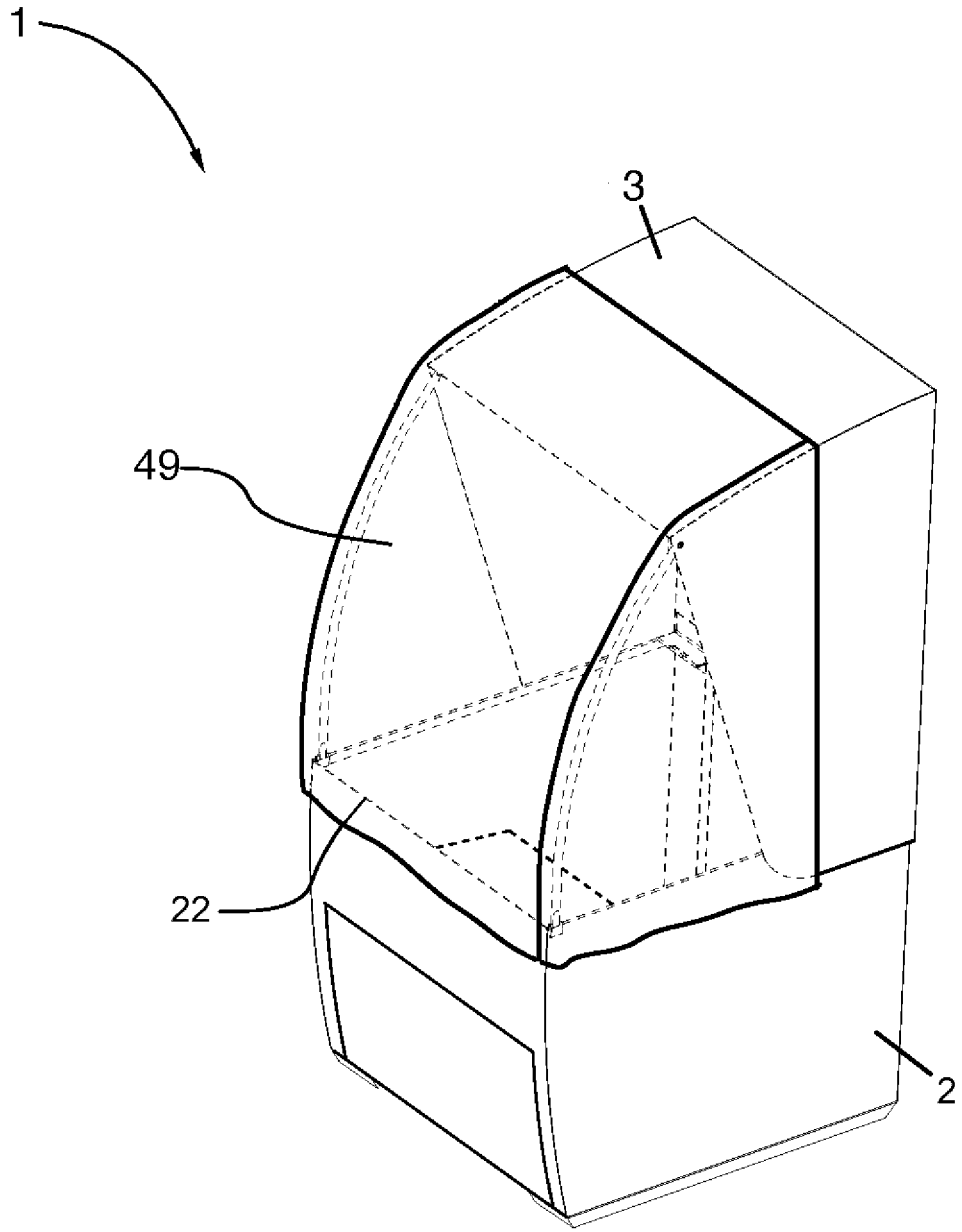
FIG. 17 shows an iso-metric view of the collapsible toilet enclosure of FIG. 1, with a privacy screen attached.

As seen in FIG. 17, the toilet enclosure 1 may further comprise a privacy screen 49 that extends downward from the upper frame portion 3 to the base portion 2 when the enclosure 1 is in the fully extended position. The privacy screen 49 may be formed form a flexible material, allowing the screen to bend and move during extension and collapsing of the toilet enclosure 1 without tearing. The privacy screen 49 can be connected to the upper frame portion 3 through any means known in the art, such as a hook/rod connecting mechanism extending around upper frame portion 3 and a corresponding hook/rod connection located adjacent to the upper edge 22 of the base portion 2.

Figure 18:
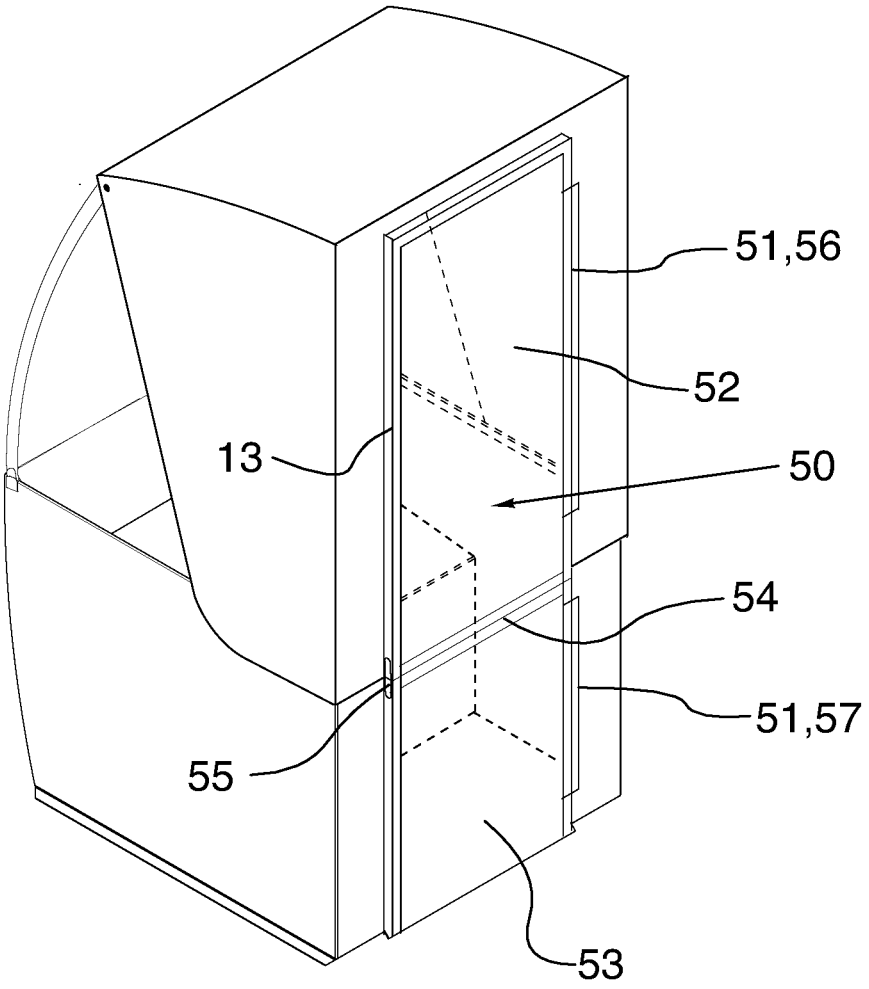
FIG. 18 shows an iso-metric view of the collapsible toilet enclosure of FIG. 1, with a collapsible door.
Figure 19:
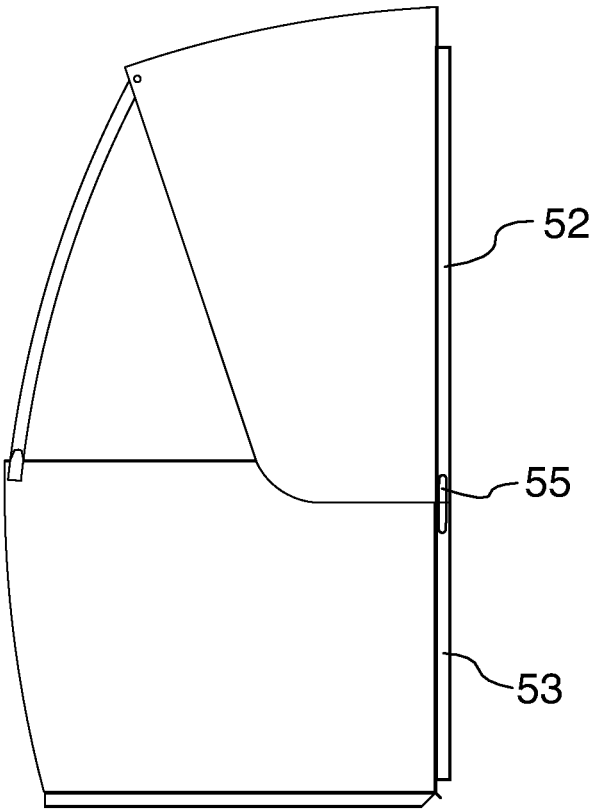
FIG. 19 shows a side view of the collapsible toilet enclosure of FIG. 18; and, FIG. 20 shows the collapsible toilet enclosure of FIG. 19 in the collapsed position.
Figure 20:
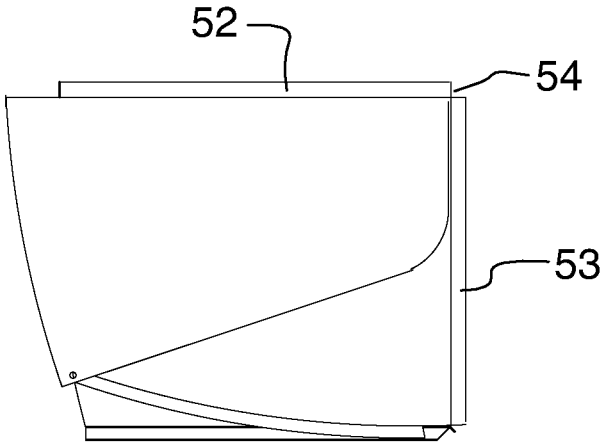

FIGS. 18 to 20 illustrate another alternative embodiment of the present invention. As seen in FIG. 18, the collapsible toilet enclosure comprises a collapsible door 50 pivotally mounted in the doorframe 13. As seen in FIG. 18, the collapsible door 50 is pivotally mounted to the doorframe 13 at a pivotal hinge connection 51, therein permitting the collapsible door 50 to swing between open and closed positions during use. The collapsible door 50 further comprises first and second door sections 52, 53, pivotally connected at a folding hinge 54. As seen in FIGS. 18 and 19, when the upper frame portion 3 is in the extended position, the collapsible door 50 is fully extended upward, and the collapsible door 50 can be locked into the extended position through the use of a locking pin 55.

The locking pin 55 secures the collapsible door 50 in the fully extended, vertical position, thereby preventing the collapsible door 50, and the first and second door sections 52, 53 from collapsing and folding inward at the hinge 54. As seen in FIG. 20, when the locking pin 55 is disengaged, the collapsible door 50 folds inward at the hinge 54. As illustrated in FIG. 18, the pivotal hinge connection 51 is divided into an upper hinge connection 56, which pivotally connects the first door section 52 to the upper frame portion 3, and a lower hinge connection 57, which pivotally connects the second door section 53 to the base portion 2. With the pivotal hinge connection 51 being split at the folding hinge 54 into the upper and lower hinge connections 56, 57, this permits the folding of the collapsible door 50 at the folding hinge 54.

Additional variants, equivalents, embodiments and features of the invention can be conceived by persons of skill in the art and are intended by the inventor to be encompassed by the following claims. The invention is defined only as set out in the claims hereof and such claims are intended to be construed broadly within the meaning supported by the specification.

The invention claimed is:

1. A collapsible toilet enclosure comprising:

a base portion having a toilet aperture and a holding receptacle in fluid communication with the toilet aperture, the base portion having walls defining an inner space;

an upper frame portion pivotally connected to the base portion, the upper frame portion having a front wall, the upper frame portion being pivotable relative to the base portion between a collapsed position where the upper frame portion forms a lid for the base portion, and an extended position where the upper frame portion and a front wall of the base portion form a front wall of the toilet enclosure;

means for selectively securing the upper frame portion in the extended position; and a doorframe formed by an opening in the front wall of the upper frame portion and an opening in the base portion, the openings aligning to form the doorframe when the upper frame portion is in the extended position, wherein when the upper frame portion is in the collapsed position and covers the base portion, a roof of the upper frame portion is adjacent to a back wall of the base portion and side walls of the upper frame portion are adjacent to side walls of the base portion.

2. The collapsible toilet enclosure according to claim 1, wherein the roof and side walls of the upper frame portion are outside of the inner space of the base portion and the upper frame portion surrounds the base portion at an upper edge of the base portion when the collapsible toilet is in the collapsed position.

3. The collapsible toilet enclosure according to claim 1, wherein the roof and side walls of the upper frame portion are substantially congruent in shape to the respective back and side walls of the base portion.

4. The collapsible toilet enclosure according to claim 1, wherein the means for securing the upper frame portion in the extended position comprises one or more support posts, extending between the upper frame portion and the base portion.

5. The collapsible toilet enclosure according to claim 1, wherein the means for securing the upper frame portion in the extended position comprises first and second support posts pivotally connected to the upper frame portion and rotatable from a collapsed position to an extended position, the support posts being connectable to the base portion when in extended positions for securing the upper frame portion in the extended position.

6. The collapsible toilet enclosure according to claim 5, wherein the first and second support posts are pivotally connected to respective first and second side walls of the upper frame portion, and the first and second support posts are rotatable to a position adjacent to the first and second side walls respectively when the support posts are in the collapsed position.

7. The collapsible toilet enclosure according to claim 4, wherein the support posts are of an arcuate shape.

8. The collapsible toilet enclosure according to claim 4, wherein the support posts and the base portion comprise respective flanges and grooves corresponding to the flanges, for connecting the support posts to the base portion.

9. The collapsible toilet enclosure according to claim 4, wherein the support posts are connectable to the base through a pin-hole connection.

10. The collapsible toilet enclosure according to claim 1, wherein the upper frame portion is pivotally connected to the base portion via first and second hinges disposed along the front wall of the upper frame portion and along the base portion on each side of the doorframe.

11. The collapsible toilet enclosure according to claim 1, further comprising a collapsible door pivotally mounted in the doorframe.

12. The collapsible toilet enclosure according to claim 11, wherein the door is pivotally mounted in the door frame to permit swinging between open and closed positions, and wherein the door comprises pivotally connected first and second door sections so that the door is in an extended position when the upper frame portion is raised relative to the base portion.

13. The collapsible toilet enclosure according to claim 12, wherein the door is lockable in the extended position.

14. The collapsible toilet enclosure according to claim 13, wherein the door is lockable with a pin.

15. The collapsible toilet enclosure according to claim 1, wherein the upper frame portion comprises one or more interconnected sections.

16. The collapsible toilet enclosure according to claim 15, wherein the one or more interconnected sections comprises respective first, second and third interlocking sections.

17. The collapsible toilet enclosure according to claim 16, wherein the first, second and third interlocking sections each have respective first, second and third roof sections forming one continuous roof that extends to the back wall of the base portion when the upper frame portion is in the extended position.

18. The collapsible toilet enclosure according to claim 16, wherein the first, second and third interlocking sections each have respective first, second and third sets of sidewalls forming continuous, upper frame portion sidewalls that extend to the first and second sidewalls of the base portion when the upper frame portion is in the extended position.

19. The collapsible toilet enclosure according to claim 15, wherein the interlocking sections are nested when the upper frame portion is in the collapsed position.

* * * * *